United States Patent [19]

Dilo et al.

[11] Patent Number: 4,651,393

[45] Date of Patent: Mar. 24, 1987

[54] UNIT FOR THE PRODUCTION OF STRUCTURED TEXTILE VELOUR NEEDLE-BONDED FABRIC WEBS

[75] Inventors: Richard Dilo; Johann P. Dilo, both of Eberbach, Fed. Rep. of Germany

[73] Assignee: Oskar Dilo Maschinenfabrik KG, Eberbach, Fed. Rep. of Germany

[21] Appl. No.: 790,495

[22] Filed: Oct. 23, 1985

[30] Foreign Application Priority Data

Dec. 7, 1984 [DE] Fed. Rep. of Germany ..... 3444763

[51] Int. Cl.[4] ..... D04H 18/00

[52] U.S. Cl. ..... 28/111

[58] Field of Search ..... 28/107, 111

[56] References Cited

U.S. PATENT DOCUMENTS 2,974,393 3/1961 Hollowell ..... 28/107

FOREIGN PATENT DOCUMENTS 2911762 10/1980 Fed. Rep. of Germany ..... 28/107

22728 of 1891 United Kingdom ..... 28/107

OTHER PUBLICATIONS

Burns, G. F. "Spooner Develops Equipment and Technology for Needled Velours Floorcoverings", *Textile Month* (Feb. 1973), pp. 69–71.

*Primary Examiner*—Robert R. Mackey

*Attorney, Agent, or Firm*—Rosen, Dainow & Jacobs

[57] ABSTRACT

Unit for the production of structured textile velour needle-bonded fabric webs from a pre-needle fleece of staple fibers, consisting of a fleece laying apparatus, a pre-needling machine and a velour needling machine, wherein at least the velour needling machine (15) is equipped with a brush belt (21) carrying the fleece to be needled and serving as needle stitch base, said belt being made up of numerous brush plates (24) carrying bristle clusters (25), the outer edges (26) of said plates (24) being of a zig-zag design formed in such a way that the edges (26) of respectively adjacent lying brush plates (24) interlock in such a way that the bristle clusters (25) along the outer edges are spaced at the same distance towards each other as those in the inner area of the brush plates (24), the bristles of the bristle clusters (24) are trimmed on their free ends in a conical or wedge-shaped manner, the holding down plate lies on the fiber fleece web and is pressed down onto it and crown needles (23) are used for the three-dimensional structuring of the pre-needled fiber fleece.

5 Claims, 3 Drawing Figures

UNIT FOR THE PRODUCTION OF STRUCTURED TEXTILE VELOUR NEEDLE-BONDED FABRIC WEBS

BACKGROUND OF THE INVENTION

The invention refers to a unit for the production of structured textile velour needle-bonded fabric webs from a pre-needled fleece of staple fibers, which is made up of a fleece laying apparatus, a pre-needling machine and a velour needling machine. Units of this mentioned type are already known. The most problematic component of such units is the velour needling machine of the conventional type. The velour needle-bonded webs produced with the known units have shortcomings in numerous aspects. In particular, they do not permit evenness and free-orientation of the surface of the fabric. Furthermore, the strength of the needle-bonded web is not sufficient, and finally the hitherto used units have a relatively high energy consumption, which again results in the fibers being more or less severely damaged or ruptured.

For pre-needling webs of fleeces made up of several layers it has been suggested to use a pre-needling machine where the needle stitch base is an endless delivery belt equipped with bristles. Such a machine however does not function fully satisfactorily as the needling is relatively uneven and in particular streakiness occurs which is caused through the type of construction. Thus such a machine is not usable as a velour needling machine.

The invention is based on the task of providing a unit for producing structured textile velour needle-bonded webs with as low mass per unit area as possible, which is characterized by great uniformity and free-orientation of the surface of the fabric as well as by high strength of the needle-bonded web, and which requires as low an energy consumption as possible for operation. For solving this task the invention suggests forming the unit in question in such a way that at least the velour needling machine is equipped with an endless brush belt supporting the fleece to be needled and acting as needle stitch base, which is composed of a multitude of brush plates carrying the bristle clusters, whose outer edges are formed in a zig-zag manner and in such a way that the edges of adjacent brush plates respectively interlock in such a way that the spacing of the bristle clusters is the same along the outer edges as the spacing in the inner area of the brush plates, that the bristles of the bristle clusters are trimmed in a conical or wedge-shaped manner on their free ends, that the holding -down plate lies on the fiber fleece web and is pressed down on it and that for the three-dimensional structuring of the pre-needled fiber fleece crown needles are used.

Advantageously, the fleece needling machine has at least two parallel arranged needle beams, wherein either both needle beams are driven by a common drive mechanism or each needle beam is associated to its own drive mechanism so that the working strokes are staggered.

It is also advantageous to place a fiber fleece drafting means between the pre-needling machine and the velour needling machine, this being particularly considered if the end product is to further undergo any deformation process through needle punching or embossing. Through the drafting of the fleece, a fiber reorientation is reached aimed at giving the material enhanced isotropic and elastic properties.

Even though the velour needling machine according to the invention is particularly suited for bringing about the three-dimensional structuring of the originally plain fiber fleece, in order to reach the desired uniform product with homogeneous, completely orientation-free pile and high strength, the pre-needling machine can also advantageously be formed in the same manner as the velour needling machine, without it however having crown needles. The needle stitch base, in the form of an endless brush belt, evenly equipped with bristles over the entire surface, offers excellent conditions for a basically uniform homogeneous needling of the fleece of the web to provide a preneedled fleece of particularly good uniformity as never achieved before . Here the quality of the end product can be still further improved particularly regarding its strength in the final condition.

FIGS. 1–3 of the drawings show a preferred embodiment of the subject matter of the invention which is described in greater detail below.

DETAILED DESCRIPTION OF THE DRAWINGS

Figure 1:
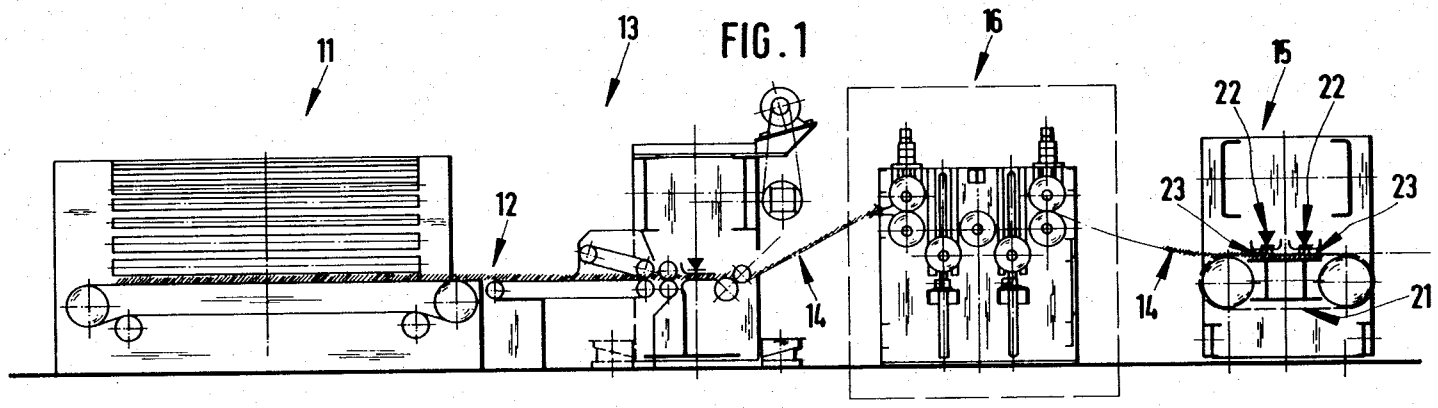
FIG. 1 shows a lateral view of the unit for producing structured textile velour needle-bonded fabric webs, formed according to the invention.

As FIG. 1 shows, the unit in question for producing structured textile velour needle-bonded fabric webs consists of a fleece laying apparatus 11 with which the voluminous web of fleece 12 to be needled is formed through superimposing numerous layers of fibers. The fleece laying apparatus 11 is followed by the pre-needling machine 13 with which the fiber fleece web 12 is compressed. The pre-needled fiber fleece web 14 is finally fed to the velour needling machine 15 in which the plain fiber fleece web 14 is given its three-dimensional structuring through an orientation-free pile formation.

In certain cases a fiber drafting means 16 is positioned between the pre-needling machine 13 and the velour needling machine 15, in order to give the end product certain desired properties resulting from treatment of the fleece 14 in this drafting means. The needling machine 13 can be of the common design for machines used for such purposes. It is however of particular advantage if a brush belt is used as needle stitch base and transporting means for the web as with the velour needling machine 15.

Figure 2:
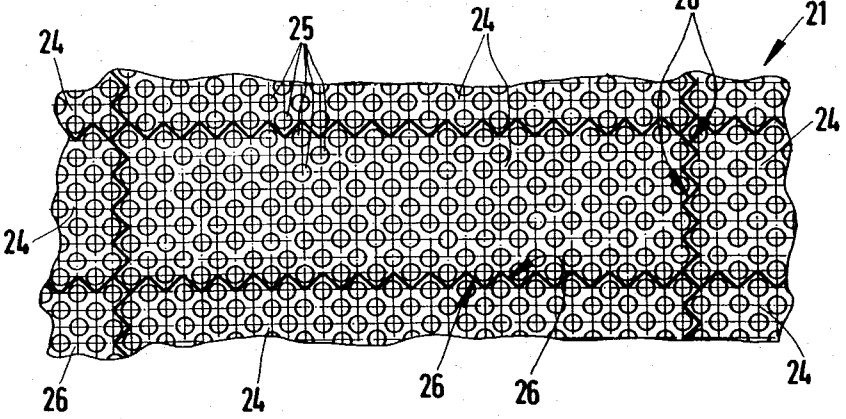
FIG. 2 shows a top view of a section of the endless brush belt made up of numerous individual brush plates.
Figure 3:
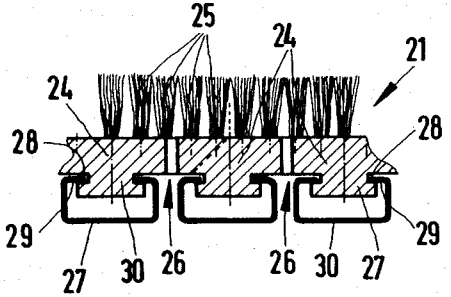
FIG. 3 shows a lateral view of adjacent-lying brush plates which make up the brush belt.

With the velour needling machine 15, a brush belt 21 serves as needle stitch base for the crown needles 23 seated on the two needle beams 22. The brush belt 21 consists of numerous brush plates 24 which are equipped with bristle clusters 25 arranged in a regular order, as particularly shown in FIG. 2. The outer edges 26 of the brush plates 24 are of zig-zag design so that adjacent lying brush plates 24 can interlock respectively, so that the most outer bristle clusters 25 along the outer edges of adjacent lying brush plates 24 are arranged with the same spacing in all directions as are the bristle clusters 25 in the inner area of the brush plate 24.

The brush plates 24 are provided with holding battens 27 on the back which have a groove 28 on opposing sides into which engage the limbs of the assembly rails 30 extending over the width of the brush belt 21. The assembly rails are attached to endless rotary delivery chains or belts or such.

With such a formation of the brush plates and arrangement of the bristle clusters 25, an absolutely even brush belt 21 is obtained which is the condition necessary for an absolutely even, uniform end product.

In order to avoid any swelling i.e. irregularities in the structure of the final product resulting from the point of the needle striking a bristle, the bristles have either a conical or wedge-shaped finish, this guaranteeing a longer life of the brush belt 21. This step also avoids any ridge formation on the point of any bristle which would have the effect of a barb, through which the fiber fleece or individual fibers of the fleece are caught up in an undesired manner. This step thus also serves the improvement of quality of the product.

With the hitherto known needling machines, the holding-down plate,through the openings of which the needles pass into and through the pre-needled fiber fleece, is fixed. This results in an undesired fluttering of the fiber fleece web when it passes through, which can be avoided by letting the holdingdown plate rest on the fiber fleece web, preferably under slight pressure, this being possible as the bristles of the brush belt 21 supporting the fiber fleece have a certain natural elasticity. Through this step the quality of the end product and particularly the material surface can be improved.

Through the suggested application of crown needles for the purpose of the three-dimensional structuring of the pre-needled fiber fleece, a voluminous velour with exceptional uniformity and evenness, and free in structure i.e. free of or free from impurities is obtained, as has not been reached by any of the already known machines. The crown needles are needles where the notches on the needle shaft are all at the same distance from the needle point, distributed around the periphery. The hitherto used fork needles are known to create a relatively thin pile of the material.

The crown needles according to the invention have the effect that the needle penetration forces are considerably less as opposed to those occurring with fork needles, so that the energy requirement of the velour needling machine is reduced to a considerable degree. This again means that the fiber damage through the needles is considerably less as well, which again means an increase in the strength of the velour needle-bonded fabric web.

As shown in FIG. 1, the velour needling machine 15 has two needle beams 22, on the one hand due to the low energy requirement and on the other hand due to an improved material quality. It is also possible to provide further needle beams, where their motion can be controlled in such a way that the working strokes occur in sequence.

If the velour needle-bonded fabric web is to undergo a more or less severe dimensional change through needle punching or embossing for example, this being of particular significance in connection with certain automobile engineering equipment elements, then a needle-bonded fabric web is desired which has even elastic properties in all directions. For such purposes of use, it is advantageous to place a fiber fleece drafting means 16 between the pre-needling machine 13 and the velour needling machine 15, as shown in FIG. 1.

The unit formed according to the invention enables the provision of extremely evenly structured textile needle-bonded fabric webs whose fabric surface has great uniformity, is orientation-free and has high strength, even with low mass per unit area.

What we claim is:

1. Unit for the production of structured textile needle-bonded fabric webs from a pre-needled fleece of staple fibers, comprising a fleece laying apparatus, a pre-needling machine and a velour needling machine, wherein the velour needling machine is equipped with an endless brush belt carrying the fleece to be needled and serving as a needle stitch base, said belt comprising a number of brush plates carrying the bristle clusters, the outer edges of said plates being of a zigzag design formed such that the edges of respectively adjacent-lying brush plates interlock such that the bristle clusters along the outer edges are spaced at the same distance towards each other as those in the inner area of the brush plates, the bristles of the bristle clusters being trimmed on their free ends in a tapering form, a holding-down plate being provided on the velour needling machine lies on the fiber fleece web and pressed down thereon, and crown needles being provided on said velour needling machine for the three dimensional structuring of the pre-needled fiber fleece.

2. Unit according to claim 1, wherein holding battens are arranged on the rear side of the brush plates, said battens having grooves which engage two inwardly bending limbs of attachment rails, said rails being arranged on endless guide members.

3. Unit according to claims 1 or 2 wherein the velour needling machine has at least two needle beams arranged in parallel.

4. Unit according to claim 1 or 2 wherein a fiber drafting means is connected between the pre-needling machine and the velour needling machine.

5. Unit according to claims 1 or 2, wherein at least the pre-needling machine has at least two needle beams arranged in parallel.

* * * * *